US005976320A

United States Patent [19]

Lund et al.

[11] Patent Number: 5,976,320

[45] Date of Patent: Nov. 2, 1999

[54] METHOD FOR PRODUCING PAPER PULP FROM FIBERS OF ANNUAL PLANTS

[75] Inventors: Gerrit Lund, Gaissach; Reinhard Tauber, Miesbach, both of Germany

[73] Assignee: Giesecke & Devrient GmbH, Munich, Germany

[21] Appl. No.: 08/908,970

[22] Filed: Aug. 8, 1997

[30] Foreign Application Priority Data

Aug. 14, 1996 [DE] Germany ..... 196 32 865

[51] Int. Cl.[6] ..... D21C 5/00

[52] U.S. Cl. ..... 162/52; 162/91; 162/95; 162/98; 162/20; 162/28; 162/17; 241/16; 241/21; 241/28

[58] Field of Search ..... 162/91, 95, 98, 162/28, 20, 17, 52; 241/16, 21, 28

[56] References Cited

U.S. PATENT DOCUMENTS 4,547,263 10/1985 Quame ..... 162/14

OTHER PUBLICATIONS

Casey, James, P., Pulp and Paper Chemistry and Chemical Technology, vol. 1 (New York: John Wiley & Sons) 548, 1980.

Smook, G.A., Handbook of Pulp & Paper Terminology (Vancouver: Angus Wilde Publications), 152, 1990.

*Primary Examiner*—Peter Chin
*Assistant Examiner*—Steven B. Leavitt
*Attorney, Agent, or Firm*—Bacon & Thomas

[57] ABSTRACT

A method for producing paper pulp containing fibers of annual plants or of secondary raw materials produced therefrom, whereby fiber materials are shortened to a length which permits production of a homogeneous, pumpable suspension of the shortened fiber materials. The fiber materials are subsequently bleached and processed into a homogeneous paper pulp.

9 Claims, 1 Drawing Sheet

METHOD FOR PRODUCING PAPER PULP FROM FIBERS OF ANNUAL PLANTS

BACKGROUND OF THE INVENTION

1. Field of the Invention

This invention relates to a method for producing paper pulp containing fibers of annual plants or of secondary raw materials produced therefrom, the fibers being bleached, shortened and processed into a homogeneous paper pulp in further processing steps. The invention further relates to a method for producing shortened fibers of annual plants or of secondary raw materials produced from annual plants.

2. Description of the Related Art

For environmental reasons, there are ideas to grow and use annual plants, such as hemp, flax, etc., specifically for papermaking in order to reduce or even completely prevent deforestation at least for this branch of industry.

At present, papers from fibers of vegetable origin, such as cotton, linters, hemp, etc., are used mainly for high-quality papers, such as shares, securities, bank notes, etc., since the raw materials are expensive and the stock preparation of vegetable fibers is very elaborate. The relatively long fibers cannot be singled in water, i.e. they conglomerate and form large lumps. When rotational motions are added, as during stirring or pumping, these fiber conglomerations tend to and form meter-long braids. A special method therefore, had to be developed for the stock preparation of vegetable fibers.

In this known method, the fibers are pressed in a first step into so-called "cakes" and several of these cakes are suspended in a bleaching boiler. With the aid of bleaching chemicals, pressure and temperature, the fibrous material oxidizes to the desired whiteness. While the cakes are still in the bleaching boiler they are rinsed with water to remove the bleaching chemicals. The entire bleaching process takes several hours. Then the cakes are taken out, crushed and slowly supplied to a beater filled with water forming a fiber suspension. Here the fibers are shortened, likewise in a several-hour process. In a further method step, the fiber suspension now capable of being conveyed with conventional pumping systems is further shortened and fibrilled until, with the provision of additives necessary for papermaking, it reaches the paper machine.

Since the paper machine works continuously and new paper pulp must therefore be supplied constantly, while the stock preparation of the fibers only takes place discontinuously and in time-intensive single processes, it is necessary to use several bleaching boilers and beaters in parallel. This method is thus very elaborate and requires many individual separate method steps.

SUMMARY OF THE INVENTION

The present invention is therefore based on the problem of providing a method for stock preparation of natural fibrous materials, in particular fibers of annual plants, which permits a simplification of the production process and a continuous processing of the fibers.

The invention is based on the idea of shortening the fibers of annual plants in a first method step to a length which permits production of a homogeneous, pumpable suspension and only then performing the bleaching. Below a certain fiber length, the fibers can be suspended homogeneously in water and no longer tend to agglomerate or spin. In this way, one can use existing continuous techniques from the wood working paper industry for the bleaching process, since no conveying problems occur, e.g. during pumping. Instead of annual plants, one may also use semifinished and finished products produced therefrom, such as spun threads or woven textiles, i.e. thread remnants or rags, as secondary raw materials and process them by the inventive method. These semifinished and finished products will be referred to in the following as secondary raw materials. The fibers and secondary raw materials will be collectively referred to as fiber materials.

Annual plants in this context are all species of plants which are harvested or gathered annually and can be used for mechanicochemical digestion as fibrous material for papermaking, for example cotton, flax, straw, bagasse, banana trees, linters, hemp, etc.

For shortening, the fiber materials are introduced simultaneously with water into a mixing apparatus forming a fiber material suspension; and immediately accelerated so as to produce a volume flow with a solid content, the so-called stock density, of less than 10%. Since the fiber materials suspension is immediately removed, there is no recurrent flowing or spinning which could hinder the further transport of the suspension. The fiber materials suspension may therefore be shortened in a conventional refiner.

Directly subsequent to shortening, the fiber material suspension is dewatered, mixed with bleaching chemicals and stored with the bleaching chemicals in a bleaching tower for a certain time to give the fiber material the desired whiteness. Subsequent to one or more washing processes the fibrous materials are finally supplied to the usual further beating in a cyclizing plant.

BRIEF DESCRIPTION OF THE DRAWING

Further advantages and embodiments will be explained with reference to FIG. 1 in which the essential method steps of the invention are shown schematically.

BRIEF DESCRIPTION OF THE PREFERRED EMBODIMENTS

Figure 1:
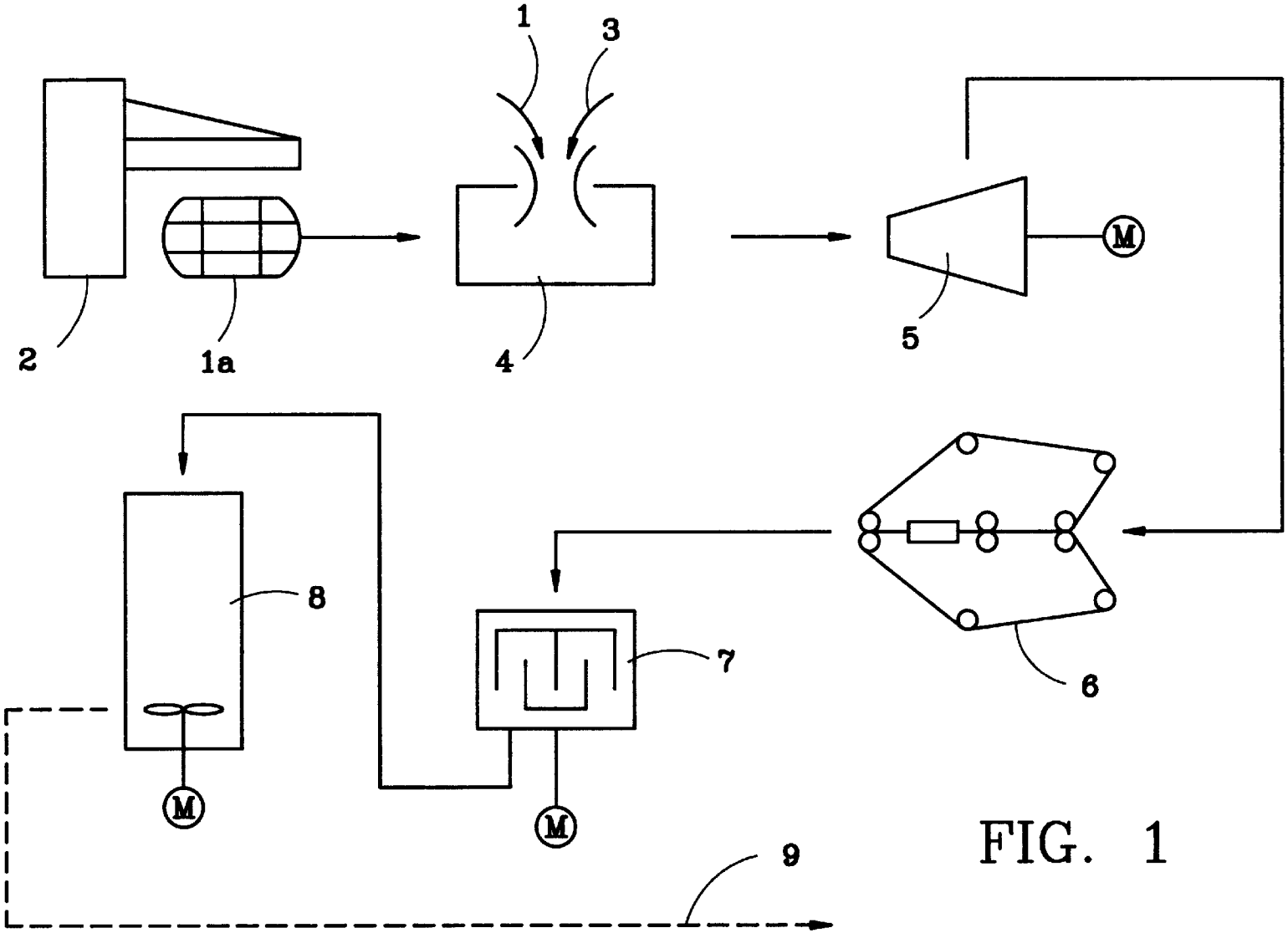

The fibrous material is usually delivered in the form of densely packed bales 1*a* and must therefore be broken down and loosened in a first step with the aid of a milling machine 2. Cotton fibers are primarily used, but fibers of other annual plants, such as hemp, flax, etc., and products spun or woven therefrom (secondary raw materials) are also suitable for being processed into paper products.

Fiber materials 1 are weighed and introduced in a certain ratio simultaneously with water 3 into a mixing apparatus 4, briefly accelerated and supplied to a refiner 5. This is preferably a conical refiners. However, other forms of refiner are also conceivable, such as a disk refiner. Since the fiber suspension arises through the simultaneous introduction of water and fibers and is immediately transported, the fibers have no opportunity to form lumps or braids. They instead pass into refiner 5 uniformly distributed. This is in part because the fiber suspension only has a stock density of at most 10%. There, the fiber materials are beaten and thereby shortened and fibrilled. In a subsequent twin wire belt press 6 the fiber materials are dewatered up to a dry content of about 40%. This yields a fiber mat which is torn in a crushing unit into crumb stock. The crumb stock is mixed with bleaching chemicals in a high-consistency mixer 7 to form a mixture of shortened fiber materials and bleaching chemicals which is supplied in the next step to a bleaching tower 8. There the chemicals are allowed to act, the storage period being up to two hours depending on the desired degree of whiteness. Subsequent to the bleaching process the fibers are washed to remove the residual chemicals and supplied to the further usual process steps of papermaking, as indicated by arrow 9.

All process steps take place continuously. This means that apparatuses in which long-lasting process steps take place, such as bleaching, must be designed in their capacity so as to permit continuous charging and continuous discharging despite the long holding time.

The continuous process run also eliminates the disadvantage in the previous method of having to provide several parallel-working apparatuses in the production line. This makes the production process considerably more cost-effective with respect to the costs for personnel, energy and chemicals.

We claim:

1. A method for producing paper pulp containing fibers of annual plants, including secondary raw materials produced therefrom, comprising the steps of:

introducing fiber materials of annual plants or secondary raw materials produced therefrom into a mixing apparatus, the annual plants being selected from the group consisting of cotton and flax;

simultaneously introducing water into the mixing apparatus to create a fiber material suspension; and then immediately accelerating the fiber material suspension away from the mixing apparatus subsequent to introducing the fiber materials and water into the mixing apparatus such that the fiber materials have no opportunity to form lumps or braids; and then shortening the fiber materials to a length which permits production of a homogenous, pumpable suspension of the shortened fiber materials; and then bleaching the shortened fiber materials; and then processing the bleached shortened fiber materials into a homogenous paper pulp.

2. A method according to claim 1, wherein the fiber material suspension created and accelerated has a stock density of less than 10%.

3. A method according to claim 2, comprising the further step of:

supplying the fiber material suspension to a refiner in which the shortening of the fiber materials is carried out.

4. A method according to claim 1, comprising the further step of:

supplying the fiber material suspension to a refiner in which the shortening of the fiber materials is carried out.

5. A method according to claim 1, comprising the further step of:

separating the shortened fiber materials from the water up to a dry content of 40%.

6. A method according to claim 1, wherein the bleaching of the shortened fiber materials comprises the steps of:

mixing the shortened fiber materials with bleaching chemicals in a high-consistency mixer; and subsequently storing the mixture of shortened fiber materials and bleaching chemicals in a bleaching tower for a predetermined time period.

7. A method according to claim 6, wherein the storing of the mixture of shortened fiber materials and bleaching chemicals in the bleaching tower is carried out for about two hours.

8. A method for producing paper pulp containing fibers of annual plants, including secondary raw materials produced therefrom, comprising the steps of:

simultaneously introducing fiber materials of annual plants or secondary raw materials produced therefrom and water into a mixer to create a fiber material suspension, the annual plants being selected from the group consisting of cotton and flax; and then immediately accelerating the fiber material suspension away from the mixer such that the fiber materials have no opportunity to form lumps or braids; and then shortening the fiber materials in a refiner.

9. A method according to claim 8, further comprising the step of:

bleaching the shortened fiber materials; and wherein the shortening of the fiber materials is to a length which permits processing of a suspension of the shortened fiber materials with conventional pumps.

* * * * *